US008295442B2

(12) United States Patent
Caiafa et al.

(10) Patent No.: US 8,295,442 B2
(45) Date of Patent: Oct. 23, 2012

(54) APPARATUS AND METHOD FOR MAGNETIC CONTROL OF AN ELECTRON BEAM

(75) Inventors: Antonio Caiafa, Niskayuna, NY (US); Maja Harfman Todorovic, Niskayuna, NY (US); Joseph Leclaire Reynolds, Amsterdam, NY (US)

(73) Assignee: General Electric Company, Niskayuna, NY (US)

( * ) Notice: Subject to any disclaimer, the term of this patent is extended or adjusted under 35 U.S.C. 154(b) by 266 days.

(21) Appl. No.: 12/845,541

(22) Filed: Jul. 28, 2010

(65) Prior Publication Data

US 2012/0027164 A1 Feb. 2, 2012

(51) Int. Cl.

| | |
|---|---|
| ***H05G 1/08*** | (2006.01) |
| ***H05G 1/52*** | (2006.01) |
| ***H01J 35/14*** | (2006.01) |
| ***H01J 35/30*** | (2006.01) |
| ***H01J 29/76*** | (2006.01) |

(52) U.S. Cl. ..... 378/137; 378/16; 378/91; 378/138; 315/364; 315/399; 315/408

(58) Field of Classification Search ..... 378/16, 378/91, 137, 138; 315/364, 399, 408
See application file for complete search history.

(56) References Cited

U.S. PATENT DOCUMENTS

| | | | | |
|---|---|---|---|---|
| 4,206,388 | A * | 6/1980 | Ishigaki et al. | 315/371 |
| 4,242,714 | A * | 12/1980 | Yoshida et al. | 361/152 |
| 5,550,442 | A * | 8/1996 | Ueyama et al. | 315/371 |
| 5,550,889 | A | 8/1996 | Gard et al. | |
| 5,812,632 | A * | 9/1998 | Schardt et al. | 378/137 |
| 5,822,395 | A * | 10/1998 | Schardt et al. | 378/137 |
| 5,898,755 | A * | 4/1999 | Meusel et al. | 378/138 |
| 6,055,294 | A * | 4/2000 | Foerst et al. | 378/137 |
| 6,091,799 | A * | 7/2000 | Schmidt | 378/137 |
| 6,111,934 | A * | 8/2000 | Foerst et al. | 378/137 |
| 6,128,367 | A | 10/2000 | Foerst et al. | |
| 6,252,935 | B1 * | 6/2001 | Styrnol et al. | 378/137 |
| 6,292,538 | B1 | 9/2001 | Hell et al. | |
| 6,339,635 | B1 * | 1/2002 | Schardt et al. | 378/113 |
| 7,082,188 | B2 * | 7/2006 | Deuringer | 378/113 |
| 7,327,092 | B2 | 2/2008 | Caiafa et al. | |
| 7,439,682 | B2 | 10/2008 | Caiafa et al. | |
| 7,639,785 | B2 | 12/2009 | Kirshner et al. | |
| 7,839,979 | B2 * | 11/2010 | Hauttmann et al. | 378/137 |

FOREIGN PATENT DOCUMENTS

| | | | |
|---|---|---|---|
| WO | 9520241 | A1 | 7/1995 |
| WO | 2008068691 | A2 | 6/2008 |
| WO | 2008155695 | A1 | 12/2008 |

* cited by examiner

*Primary Examiner* — Allen C. Ho
(74) *Attorney, Agent, or Firm* — Marie-Claire B. Maple

(57) ABSTRACT

An apparatus and method for an electron beam manipulation coil for an x-ray generation system includes the use of a control circuit. The control circuit includes a first low voltage source, a second low voltage source, and a first switching device coupled in series with the first low voltage source and configured to create a first current path with the first low voltage source when in a closed position. The control circuit also includes a second switching device coupled in series with the second low voltage source and configured to create a second current path with the second low voltage source when in a closed position and a capacitor coupled in parallel with an electron beam manipulation coil and positioned along the first and second current paths.

22 Claims, 8 Drawing Sheets

APPARATUS AND METHOD FOR MAGNETIC CONTROL OF AN ELECTRON BEAM

BACKGROUND OF THE INVENTION

Embodiments of the invention relate generally to diagnostic imaging and, more particularly, to an apparatus and method for magnetically controlling an electron beam (e-beam).

X-ray systems typically include an x-ray tube, a detector, and a support structure for the x-ray tube and the detector. In operation, an imaging table, on which an object is positioned, is located between the x-ray tube and the detector. The x-ray tube typically emits radiation, such as x-rays, toward the object. The radiation typically passes through the object on the imaging table and impinges on the detector. As radiation passes through the object, internal structures of the object cause spatial variances in the radiation received at the detector. The detector then emits data received, and the system translates the radiation variances into an image, which may be used to evaluate the internal structure of the object. One skilled in the art will recognize that the object may include, but is not limited to, a patient in a medical imaging procedure and an inanimate object as in, for instance, a package in an x-ray scanner or computed tomography (CT) package scanner.

X-ray tubes include a rotating anode structure for the purpose of distributing the heat generated at a focal spot. The anode is typically rotated by an induction motor having a cylindrical rotor built into a cantilevered axle that supports a disc-shaped anode target and an iron stator structure with copper windings that surrounds an elongated neck of the x-ray tube. The rotor of the rotating anode assembly is driven by the stator.

An x-ray tube cathode provides an electron beam that is accelerated using a high voltage applied across a cathode-to-anode vacuum gap to produce x-rays upon impact with the anode. The area where the electron beam impacts the anode is often referred to as the focal spot. Typically, the cathode includes one or more cylindrical or flat filaments positioned within a cup for providing electron beams to create a high-power, large focal spot or a high-resolution, small focal spot, as examples. Imaging applications may be designed that include selecting either a small or a large focal spot having a particular shape, depending on the application. Typically, an electrically resistive emitter or filament is positioned within a cathode cup, and an electrical current is passed therethrough, thus causing the emitter to increase in temperature and emit electrons when in a vacuum.

The shape of the emitter or filament affects the focal spot. In order to achieve a desired focal spot shape, the cathode may be designed taking the shape of the filament into consideration. However, the shape of the filament is not typically optimized for image quality or for thermal focal spot loading. Conventional filaments are primarily shaped as coiled or helical tungsten wires for reasons of manufacturing and reliability. Alternative design options may include alternate design profiles, such as a coiled D-shaped filament. Therefore, the range of design options for forming the electron beam from the emitter may be limited by the filament shape, when considering electrically resistive materials as the emitter source.

Electron beam (e-beam) wobbling is often used to enhance image quality. Typically, wobble is achieved using electrostatic e-beam deflection. However, higher image quality can be achieved by using magnetic deflection. Wobbling via magnetic deflection may achieve a high image quality by ensuring that the electron beam moves from one position to the next usually as quickly as possible while staying in the desired position without straying. However, known systems that perform magnetic wobbling use complex topologies that often include bulky and expensive high voltage parts and do not achieve the fast and stable magnetic wobbling desired for enhanced image quality.

Therefore, it would be desirable to develop an apparatus and method for magnetic deflection that overcomes the aforementioned drawbacks and achieves fast and stable e-beam magnetic wobbling.

BRIEF DESCRIPTION OF THE INVENTION

Embodiments of the invention are directed to an apparatus and method for magnetic control of an e-beam.

Therefore, in accordance with one aspect of the invention, a control circuit for an electron beam manipulation coil for an x-ray generation system is set forth. The control circuit includes a first low voltage source, a second low voltage source, and a first switching device coupled in series with the first low voltage source and configured to create a first current path with the first low voltage source when in a closed position. The control circuit also includes a second switching device coupled in series with the second low voltage source and configured to create a second current path with the second low voltage source when in a closed position and a capacitor coupled in parallel with an electron beam manipulation coil and positioned along the first and second current paths.

In accordance with another aspect of the invention, a method for driving an electron beam manipulation coil includes the step of (A) closing a first switching device to cause a first current at a first polarity to flow along a first current path, through a resonance circuit, and through a first energy storage device, the resonance circuit comprising an electron beam manipulation coil and a resonance capacitor. The method also includes the steps of (B) opening the first switching device after closing the first switching device to initiate a first resonance cycle in the resonance circuit and (C) closing a second switching device after the first resonance cycle has been initiated to cause a second current at a second polarity to flow along a second current path, through the resonance circuit, and through a second energy storage device.

In accordance with another aspect of the invention, a computed tomography (CT) system includes a gantry having an opening therein for receiving an object to be scanned and a table positioned within the opening of the rotatable gantry and moveable through the opening. The CT system also includes an x-ray tube coupled to the rotatable gantry and configured to emit a stream of electrons toward a target, the target positioned to direct a beam of x-rays toward a detector and a deflection coil mounted on the x-ray tube and positioned to deflect the stream of electrons in a first direction. A control circuit is also included in the CT system and is electrically coupled to the deflection coil. The control circuit includes a first low voltage source, a second low voltage source and a first switch coupled to the first low voltage source and configured to create a first current path with the first low voltage source when the first switch is closed. The control circuit also includes a second switch coupled to the second low voltage source and configured to create a second current path with the second low voltage source when the second switch is closed and a resonance capacitor coupled in parallel with the deflection coil and positioned along the first and second current paths. A controller electrically is coupled to the control circuit and programmed to control switching of the first and second switches.

Various other features and advantages will be made apparent from the following detailed description and the drawings.

BRIEF DESCRIPTION OF THE DRAWINGS

The drawings illustrate preferred embodiments presently contemplated for carrying out the invention.

In the drawings.

DETAILED DESCRIPTION

The operating environment of embodiments of the invention is described with respect to a sixty-four-slice computed tomography (CT) system. However, it will be appreciated by those skilled in the art that embodiments of the invention are equally applicable for use with other multi-slice configurations. Moreover, embodiments of the invention will be described with respect to the detection and conversion of x-rays. However, one skilled in the art will further appreciate that embodiments of the invention are equally applicable for the detection and conversion of other high frequency electromagnetic energy. Embodiments of the invention will be described with respect to a "third generation" CT scanner, but is equally applicable with other CT systems, surgical C-arm systems, and other x-ray tomography systems as well as numerous other medical imaging systems implementing an x-ray tube, such as x-ray or mammography systems.

Figure 1:
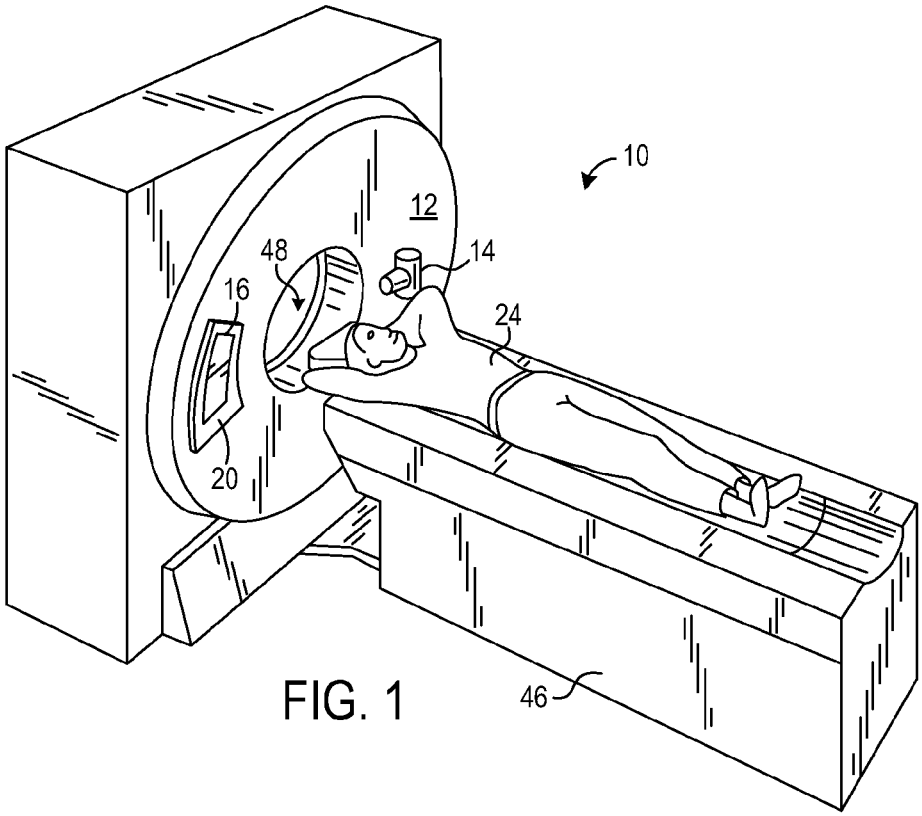
FIG. 1 is a pictorial view of an imaging system.

FIG. 1 is a block diagram of an embodiment of an imaging system 10 designed both to acquire original image data and to process the image data for display and/or analysis in accordance with the embodiments of invention. It will be appreciated by those skilled in the art that the embodiments of invention are applicable to numerous medical imaging systems implementing an x-ray tube, such as x-ray or mammography systems. Other imaging systems such as computed tomography systems and digital radiography systems, which acquire image three dimensional data for a volume, also benefit from the embodiments of invention. The following discussion of x-ray system 10 is merely an example of one such implementation and is not intended to be limiting in terms of modality.

Figure 2:
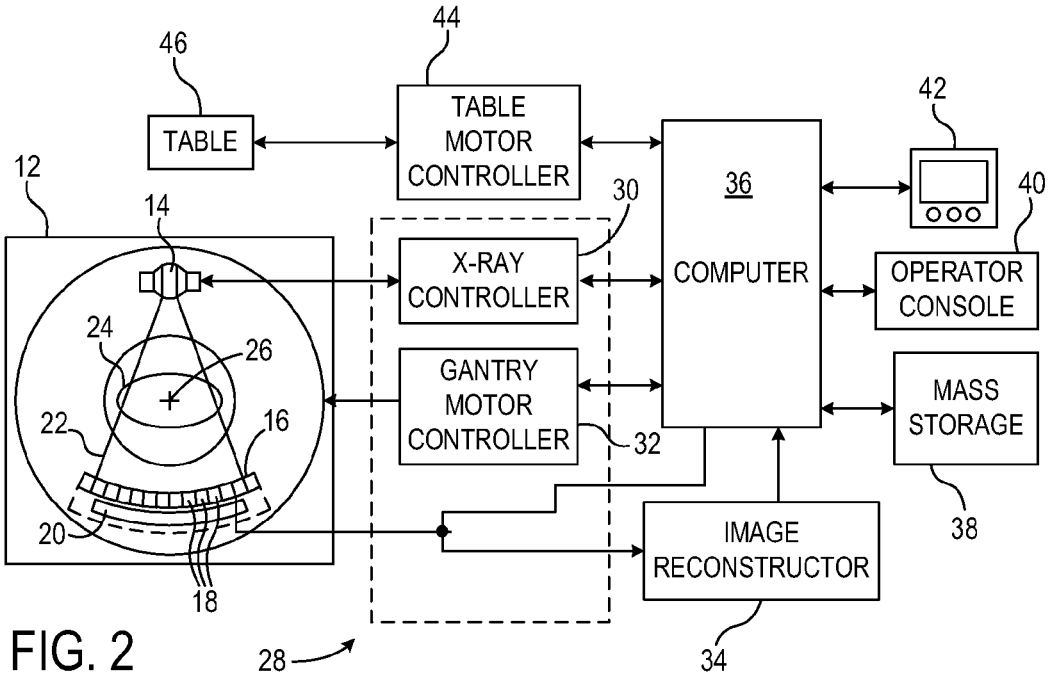
FIG. 2 is a block schematic diagram of the system illustrated in FIG. 1.

Referring to FIG. 1, a computed tomography (CT) imaging system 10 is shown as including a gantry 12 representative of a "third generation" CT scanner. Gantry 12 has an x-ray tube assembly or x-ray source assembly 14 that projects a cone beam of x-rays toward a detector assembly 16 on the opposite side of the gantry 12. Referring now to FIG. 2, detector assembly 16 is formed by a plurality of detectors 18 and data acquisition systems (DAS) 20. The plurality of detectors 18 sense the projected x-rays 22 that pass through a medical patient 24, and DAS 20 converts the data to digital signals for subsequent processing. Each detector 18 produces an analog electrical signal that represents the intensity of an impinging x-ray beam and hence the attenuated beam as it passes through the patient 24. During a scan to acquire x-ray projection data, gantry 12 and the components mounted thereon rotate about a center of rotation 26.

Rotation of gantry 12 and the operation of x-ray source assembly 14 are governed by a control mechanism 28 of CT system 10. Control mechanism 28 includes an x-ray controller 30 that provides power and timing signals to an x-ray source assembly 14 and a gantry motor controller 32 that controls the rotational speed and position of gantry 12. An image reconstructor 34 receives sampled and digitized x-ray data from DAS 20 and performs high speed reconstruction. The reconstructed image is applied as an input to a computer 36 which stores the image in a mass storage device 38. Computer 36 also has software stored thereon corresponding to electron beam positioning and magnetic field control, as described in detail below.

Computer 36 also receives commands and scanning parameters from an operator via console 40 that has some form of operator interface, such as a keyboard, mouse, voice activated controller, or any other suitable input apparatus. An associated display 42 allows the operator to observe the reconstructed image and other data from computer 36. The operator supplied commands and parameters are used by computer 36 to provide control signals and information to DAS 20, x-ray controller 30 and gantry motor controller 32. In addition, computer 36 operates a table motor controller 44 which controls a motorized table 46 to position patient 24 and gantry 12. Particularly, table 46 moves patient 24 through a gantry opening 48 of FIG. 1 in whole or in part.

Figure 3:
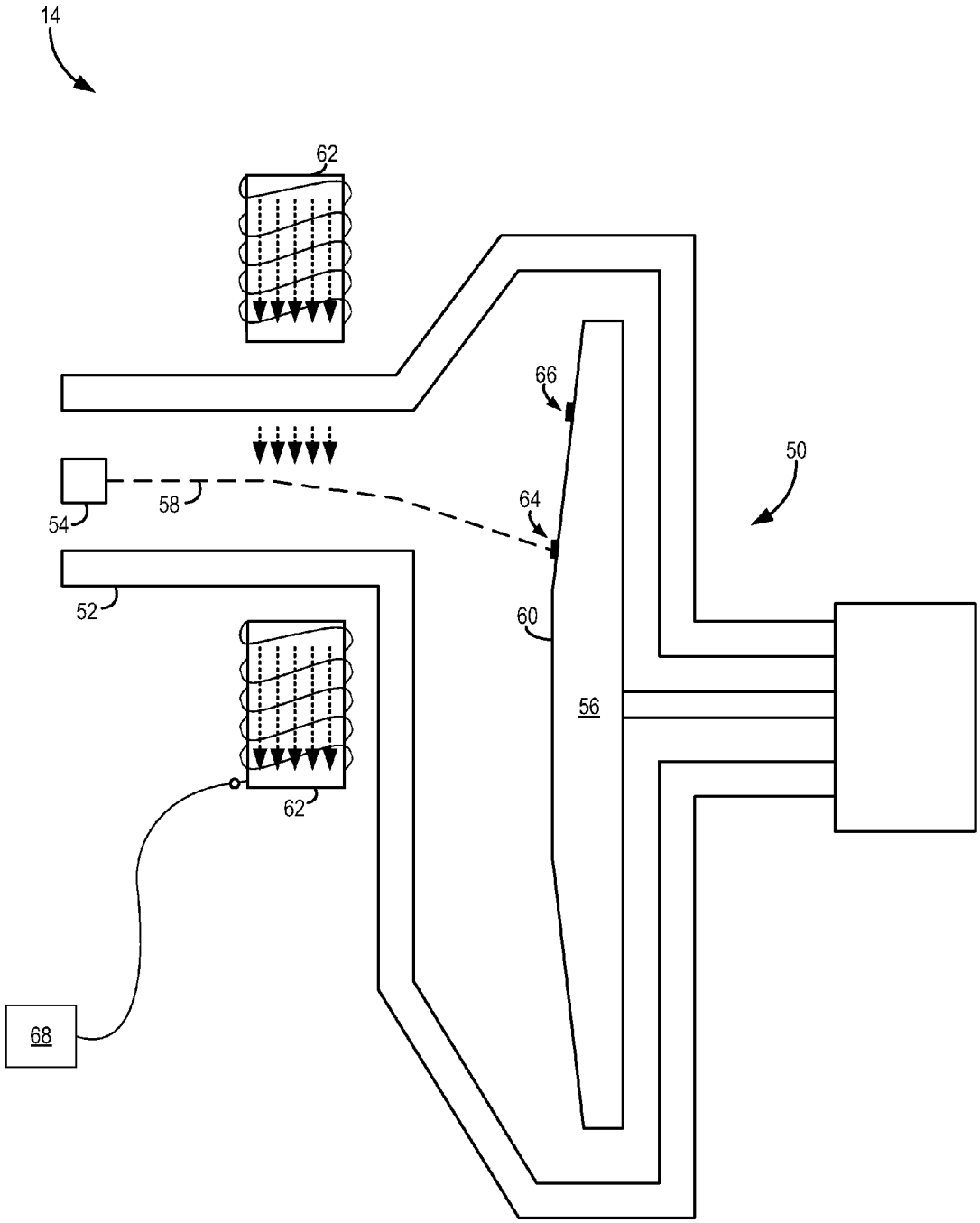
FIG. 3 is a cross-sectional view of an x-ray tube assembly according to an embodiment of the invention and useable with the imaging system illustrated in FIG. 1.

FIG. 3 illustrates a cross-sectional view of x-ray tube assembly 14 according to an embodiment of the invention. X-ray tube assembly 14 includes an x-ray tube 50 that includes a vacuum chamber or frame 52 having a cathode assembly 54 and a target or rotating anode 56 positioned therein. Cathode assembly 54 is comprised of a number of separate elements, including a cathode cup (not shown) that supports the filament (not shown) and serves as an electrostatic lens that focuses a beam of electrons 58 emitted from the heated filament toward a surface 60 of target 56.

A coil 62 is mounted in x-ray tube assembly 14 at a location near the path of electron beam 58. According to one embodiment, coil 62 is wound as a solenoid and is positioned over and around vacuum chamber 52 such that the magnetic field created acts on electron beam 58, causing electron beam 58 to deflect and move between a pair of focal spots or positions 64, 66. The direction of movement of electron beam 58 is determined by the direction of current flow though deflection coil 62, which is controlled via a control circuit 68 coupled to coil 62, as described in more detail with respect to FIGS. 4-7.

Figure 4:
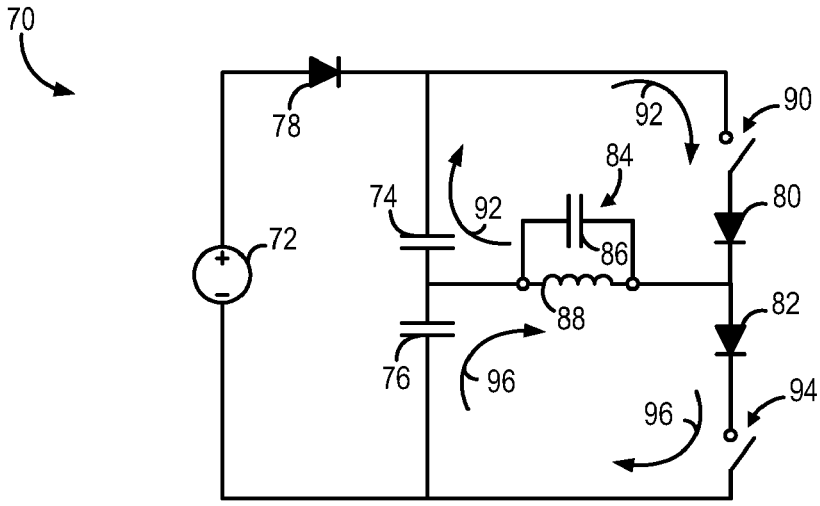
FIG. 4 is an electrical circuit diagram of a resonance circuit according to an embodiment of the invention.

FIG. 4 illustrates a control circuit 70 for an x-ray tube assembly, such as control circuit 68 provided in x-ray tube assembly 14 of FIG. 3. Control circuit 70 includes a voltage source 72 that provides a supply voltage to a first capacitor or low voltage power supply 74 and a second capacitor or low voltage power supply 76. A blocking diode 78 is positioned between voltage source 72 and first low voltage source 74 to prevent the backward flow of current into voltage source 72. Control circuit 70 also includes first and second diodes 80, 82 and a resonant circuit 84 comprising a resonant capacitor 86 positioned in parallel with a load 88, such as, for example, deflection coil 62 of FIG. 3. A first switch 90, which is closeable to form a first current path 92, and a second switch 94, which is closeable to form a second current path 96, are also provided in control circuit 70. In operation, switches 90, 94 are selectively opened and closed to generate a magnetic field in coil 88 to control deflection of an electron beam. According to one embodiment, the switching time is fixed at approximately 10 microseconds.

Figure 5:
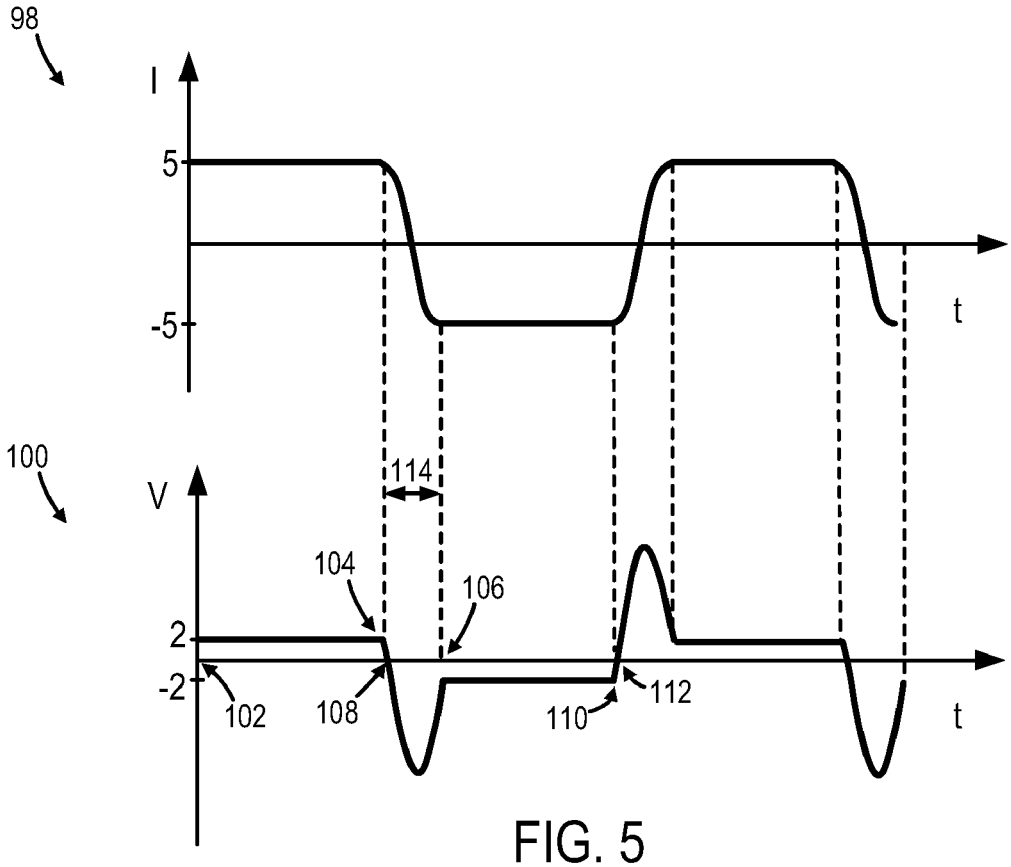
FIG. 5 is a pair of exemplary graphs illustrating developed voltage and current using the electrical circuit of FIG. 4.

Referring now to FIGS. 4 and 5 together, current and voltage waveforms 98, 100 of FIG. 5 illustrate the respective voltage and current across load 88 as switches 90, 94 of FIG. 4 are selectively opened and closed. Exemplary numerical voltage and current values are included in FIG. 5 for explanation purposes only. One skilled in the art will recognize that voltage source 72 may be selected based on a desired current for control circuit 70. At t(0) 102, first switch 90 is closed while second switch 94 is held open, resulting in a 5 A current across load 88. At t(1) 104, first switch 90 is opened, and energy stored in resonant capacitor 86 begins discharging. As resonant capacitor 86 discharges, voltage and current drop, and resonance develops between resonant capacitor 86 and load 88. During the resonance cycle, resonant capacitor 86 recovers some charge. Referring to voltage waveform 100, second switch 94 is closed before voltage reaches t(3) 106, based on a desired voltage condition. According to one embodiment, second switch 94 is closed after the voltage becomes negative at t(2) 108. The resonance cycle ends at t(3) 106 when the current across load 88 reaches −5 A. At t(4) 110, second switch 94 is opened, energy stored in resonance capacitor 86 begins discharging, triggering a second resonance cycle. At t(5) 112, after the voltage becomes positive, first switch 90 is closed, and the switching cycle repeats. The time between t(1) 104 and t(3) 106 defines half of a resonant period 114. Current and voltage waveforms 98, 100 exhibit a period and a duty cycle. According to various embodiments, the period may be of any value larger than half of the resonant period established by load 88 and resonant capacitor 86. Likewise, the duty cycle may be any value between approximately 1-2% and 100% as long as each part of the waveform is larger than half of the resonant period. The resonant period is defined by the value of the inductance of coil 88 and capacitance 86.

Accordingly, control circuit 70 achieves fast current inversion using a low voltage source by taking advantage of the resonance cycle that is triggered when a capacitor is connected in parallel with a deflection coil and when a pair of switches are controlled to open and close at specified points on voltage and current diagrams. Further, control circuit 70 is able to achieve the fast current inversion with controlled or minimized resistive losses. Switching losses are limited during current inversion due to the resonant communication, and overall conduction losses are limited because only two switches are used in the control circuit. Further, as shown in FIG. 5, the voltage developed in load 88 is very sinusoidal, resulting in low electromagnetic interference (EMI). Also, the coil current has very little variance (e.g., less than one percent), which results in very stable wobbling and a constant e-beam position during data collection.

According to one embodiment, operation of control circuit 70 is determined based on an input to an operator console, such as operator console 40 of FIG. 2. Based on the type of exam being performed, software loaded on a computer, such as computer 36 of FIG. 2, determines desired focal spot positions for the electron beam and calculates the magnetic field to be applied to direct the electron beam to the desired focal spot positions. A controller, such as controller 30 of FIG. 2, is programmed to transmit switching commands to control circuit 70 to generate the desired magnetic field.

Figure 6:
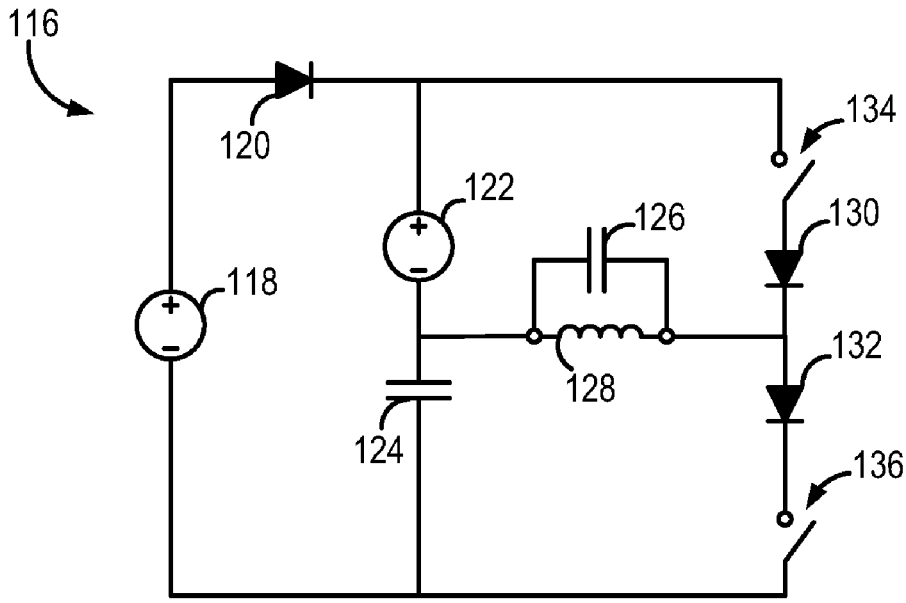
FIG. 6 is an electrical circuit diagram of a resonance circuit according to another embodiment of the invention.

Referring now to FIG. 6, a control circuit 116 is illustrated according to an alternative embodiment of the invention. Control circuit 116 includes a first voltage supply 118, a blocking diode 120, a second voltage supply 122, a capacitor 124, a resonant capacitor 126 in parallel with a coil 128, a pair of diodes 130, 132, and a pair of switches 134, 136. Thus, control circuit 116 differs from control circuit 70 of FIG. 4 in that one of the two series capacitors 74, 76 of FIG. 4 is replaced by low voltage supply 122.

Figure 7:
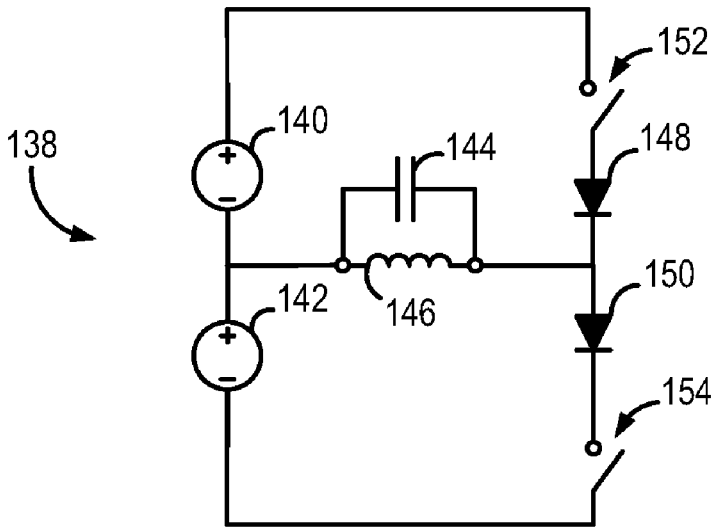
FIG. 7 is an electrical circuit diagram of a resonance circuit according to another embodiment of the invention.

FIG. 7 illustrates a control circuit 138 according to another embodiment of the invention. Control circuit 138 includes a first low voltage supply 140, a second low voltage supply 142, a resonant capacitor 144 in parallel with a load 146, a pair of diodes 148, 150, and a pair of switches 152, 154. According to one embodiment, first and second low voltage supplies 140, 142 each supply a voltage of approximately 2V. However, voltage supplies 140, 142 may be selected based on a desired magnitude of applied current.

Embodiments of the invention described above use a single coil and corresponding control circuit to deflect an electron beam between two focal spots. As would readily be understood by one skilled in the art, such a configuration could be used to deflect an electron beam between two focal spots separated by a desired distance in a desired direction with respect to the anode. For example, a control circuit coupled to the deflection coil may be configured to deflect an electron beam between two points along an x-axis (i.e., in an x-direction).

According to another embodiment of the invention, an x-ray tube assembly may include multiple deflection coils each having its own control circuit. In such a multiple deflection coil embodiment, two or more deflection coils and their respective control circuits may be configured to deflect the electron beam in multiple directions. For example, a first deflection coil/control circuit assembly may cause the electron beam to deflect between two points in a first direction (e.g., along an x-axis), and a second deflection coil/control circuit assembly may cause the electron beam to deflect between two points in a second direction (e.g., along a z-axis).

Embodiments of the invention described herein also may be used in a control circuit for dynamic magnetic focusing of an electron beam with a focusing coil. Dynamic magnetic focusing is used when the accelerating voltage between the cathode and the target is rapidly changed between two values, such as, for example, in dual energy imaging. When the accelerating voltage is rapidly changed, the electron beam ideally maintains focus on the target without changing the geometrical features of the focal spot. In order to maintain the geometry of the focal spot, the focusing magnetic field, and in turn the current through the focusing coil, is adjusted between two values: the value for low voltage and the value for high voltage.

Figure 8:
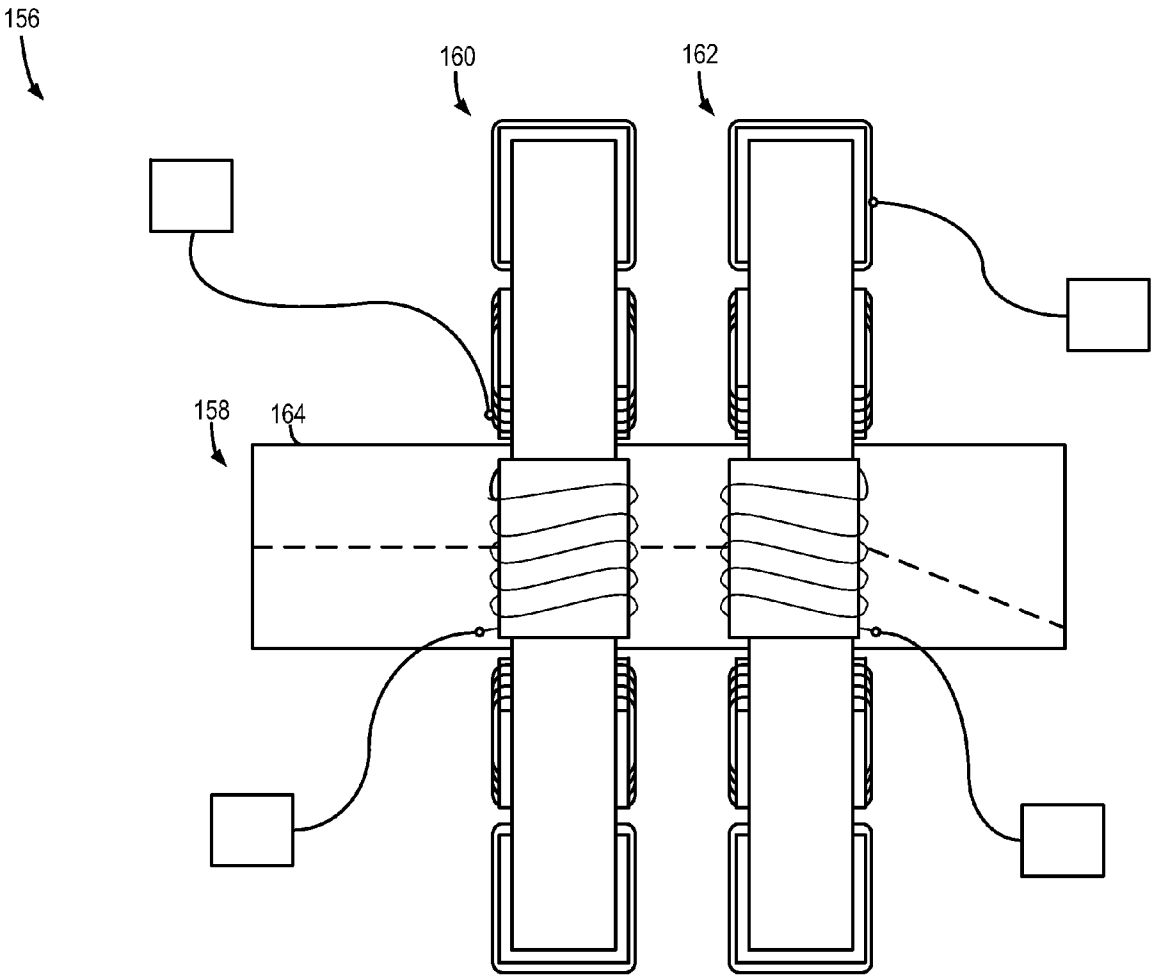
FIG. 8 is a side view of a multiple control circuit assembly for an x-ray tube assembly according to an embodiment of the invention and useable with the imaging system illustrated in FIG. 1.

FIG. 8 illustrates a side view of a multiple function control circuit assembly 156 for an x-ray tube 158 that utilizes the control circuitry described in detail above to provide dynamic magnetic deflection and focusing of an electron beam, according to another embodiment of the invention. Control circuit assembly 156 includes a pair of partial coil assemblies 160, 162 positioned around a vacuum chamber or frame 164.

Figure 9:
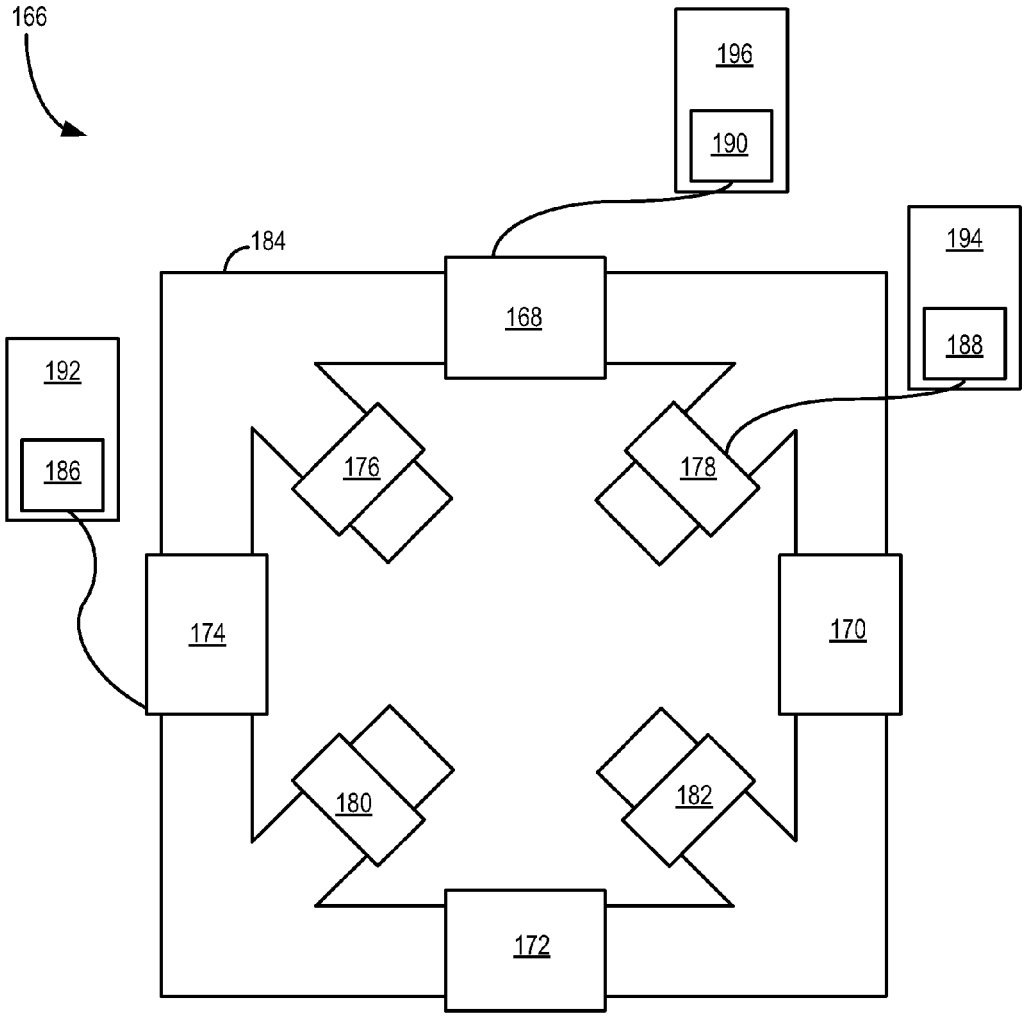
FIG. 9 is an exemplary embodiment of a partial coil assembly usable with the multiple control circuit assembly illustrated in FIG. 8.

According to one embodiment, partial coil assemblies 160, 162 are configured in a manner similar to exemplary coil structure 166, illustrated in FIG. 9. As shown, exemplary coil structure 166 includes a plurality of partial coils 168, 170, 172, 174, 176, 178, 180, 182 mounted on a yoke 184. Partial coils 168-182 are electrically connected in groups to form overall coils, which are controlled using a plurality of control circuits 186, 188, 190 via respective controllers 192, 194, 196 to generate dipole and quadrapole magnetic fields. Controllers 192-196 are programmed to control switching of respective control circuits 186-190. Alternatively, a universal controller may be provided to control switching of controllers 192-196. In such an embodiment, the universal controller may be programmed with master/slave logic and a logic control may be provided for each control circuit, for example.

According to one embodiment, partial coils 170, 174 may be connected to form one overall coil and electrically coupled to control circuit 186 to create a dipole field to control deflection in a first direction. Likewise partial coils 168, 172 may be connected to form a second overall coil, which is electrically coupled to control circuit 190 to create a second dipole field control deflection in a second direction. Alternatively, partial coils 168-174 may all be connected together to form a single overall coil that is controlled by either of control circuits 186, 190 to create a quadrupole field. Partial coils 176-182 may also be connected together to form an overall coil that is controlled by control circuit 188. One skilled in the art will recognize that, by connecting partial coils 176-182 to one another in various manners, different dipole and quadrupole magnetic fields may be generated, as explained in more detail with respect to FIGS. 10A-D. Further, while three control circuits are provided in FIG. 9, one skilled in the art will recognize that a given partial coil assembly 160, 162 may include less than three control circuits based on its functionality.

Figure 10A:
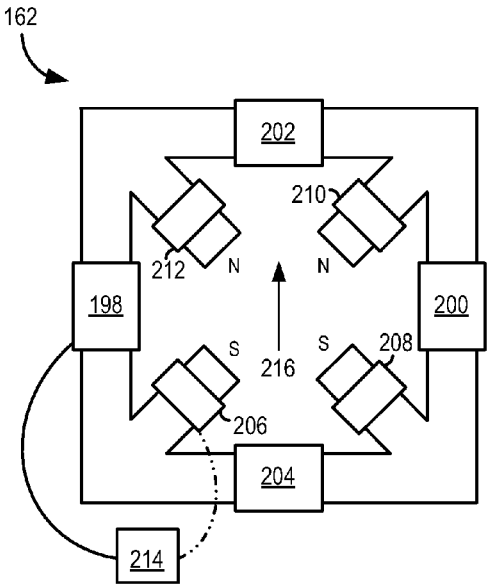
FIGS. 10A-10D illustrate an exemplary control scheme for the multiple control circuit assembly of FIG. 8.

FIGS. 10A-D illustrate exemplary control schemes for a partial coil assembly, such as partial coil assemblies 160, 162 of FIG. 8, having a number of partial coils 198, 200, 202, 204, 206, 208, 210, 212. As shown in FIG. 10A, partial coil assembly 162 may use a control circuit 214 connected to partial coils 198, 200 to generate a diopole magnetic field in a first direction 216. Alternatively, a similar dipole field may be created by connecting partial coils 206-212 to cause deflection in the first direction 216.

Figure 10B:
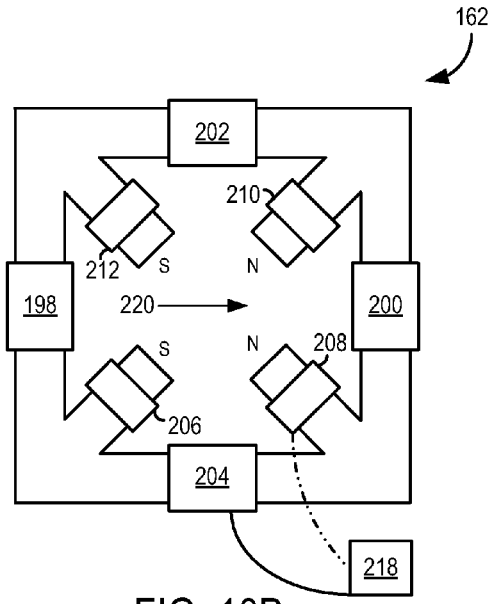

Referring now to FIG. 10B, a subset of partial coils 198-212 may be connected and controlled via a control circuit 218 to cause deflection in a second direction 220. For example, partial coils 202, 204 may be connected together to generate a dipole magnetic field as shown. Alternatively, a similar dipole field may be created by connecting partial coils 206-212 in a different manner than used to generate the dipole field shown in FIG. 10A.

Figure 10C:
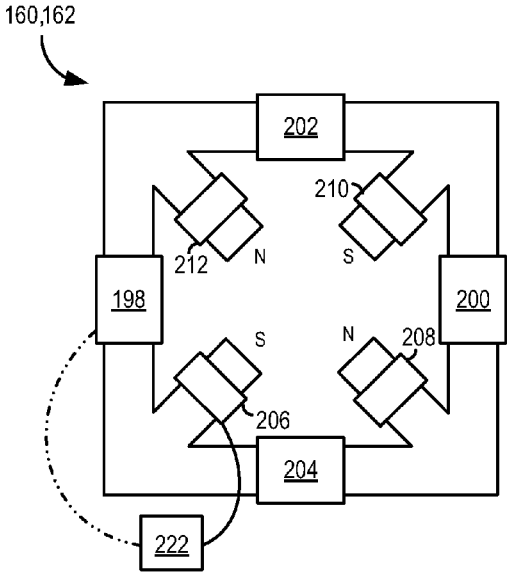
Figure 10D:
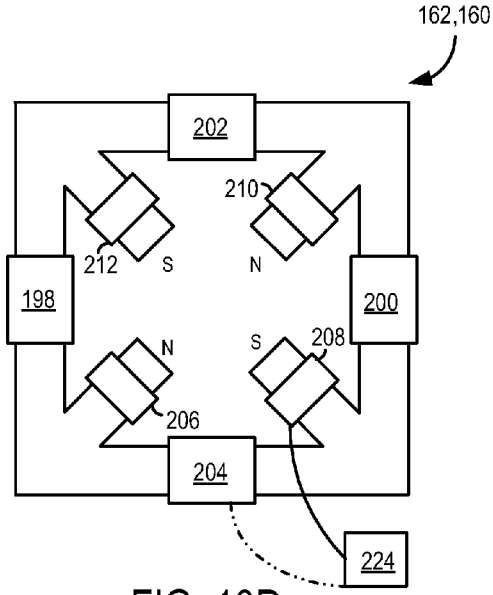

Magnetic control of the focus of an electron beam is achieved by generating quadrupole magnetic fields, as shown in FIGS. 10C and 10D. According to one embodiment, a subgroup of partial coils 198-212 of partial coil assembly 160, 162 or all of partial coils 198-212 of partial coil assembly 160 may be connected together and controlled using a controller 222 to generate the quadrupole field illustrated in FIG. 10C, which controls focus in a first direction (e.g., an x-direction). For example, partial coils 206-212 or partial coils 198-204 may be connected together in such a manner to generate the desired field. Alternatively, all partial coils 198-212 may be connected together and controlled by a common control circuit 222 to achieve the desired field.

FIG. 10D illustrates an alternative quadrupole magnetic field used to control focus of the electron beam in a second direction (e.g., a z-direction). Such control is achieved using a control circuit 224 to generate a quadrupole magnetic field using the partial coil assembly that was not used for control of focus in the first direction. For example, if partial coil assembly 160 was used to control focus in an x-direction, partial coil assembly 162 would be used to control focus in a z-direction. To generate the quadrupole magnetic field, partial coils 198-204 or partial coils 206-212 may be connected together in an alternative manner than that used to generate the quadrupole field of FIG. 10C.

One skilled in the art will recognize that the control schemes described with respect to FIGS. 10A-D may be combined and implemented on partial coil assemblies 160, 162 in various manners to achieve a desired electron beam control strategy. Further, a skilled artisan will recognize that, while embodiments have been described herein using eight partial coils, additional partial coils may be added to partial coil assemblies to increase flexibility in partial coil selection and to increase control and magnitude of the generated magnetic field.

Figure 11:
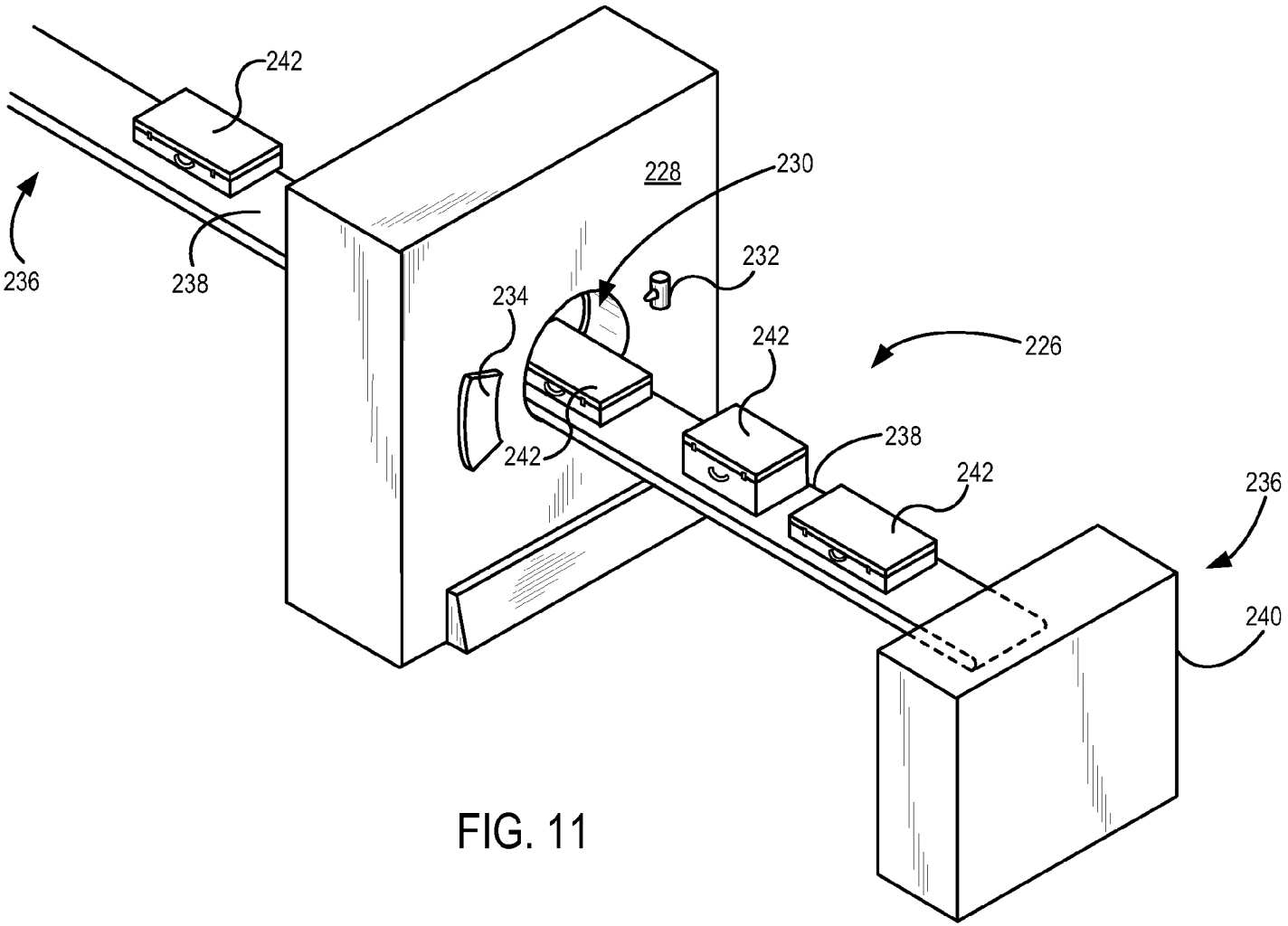
FIG. 11 is a pictorial view of an x-ray system for use with a non-invasive package inspection system according to an embodiment of the invention.

Referring now to FIG. 11, package/baggage inspection system 226 includes a rotatable gantry 228 having an opening 230 therein through which packages or pieces of baggage may pass. The rotatable gantry 228 houses a high frequency electromagnetic energy source 232 as well as a detector assembly 234 having detectors similar to those shown in FIG. 2. A conveyor system 236 is also provided and includes a conveyor belt 238 supported by structure 240 to automatically and continuously pass packages or baggage pieces 242 through opening 230 to be scanned. Objects 242 are fed through opening 230 by conveyor belt 238, imaging data is then acquired, and the conveyor belt 238 removes the packages 242 from opening 230 in a controlled and continuous manner. As a result, postal inspectors, baggage handlers, and other security personnel may non-invasively inspect the contents of packages 242 for explosives, knives, guns, contraband, etc.

A technical contribution for the disclosed method and apparatus is that it provides for a computer implemented apparatus and method for magnetically controlling an electron beam.

Therefore, in accordance with one embodiment, a control circuit for an electron beam manipulation coil for an x-ray generation system is set forth. The control circuit includes a first low voltage source, a second low voltage source, and a first switching device coupled in series with the first low voltage source and configured to create a first current path with the first low voltage source when in a closed position. The control circuit also includes a second switching device coupled in series with the second low voltage source and configured to create a second current path with the second low voltage source when in a closed position and a capacitor coupled in parallel with an electron beam manipulation coil and positioned along the first and second current paths.

In accordance with another embodiment, a method for driving an electron beam manipulation coil includes the step of (A) closing a first switching device to cause a first current at a first polarity to flow along a first current path, through a resonance circuit, and through a first energy storage device, the resonance circuit comprising an electron beam manipulation coil and a resonance capacitor. The method also includes the steps of (B) opening the first switching device after closing the first switching device to initiate a first resonance cycle in the resonance circuit and (C) closing a second switching device after the first resonance cycle has been initiated to cause a second current at a second polarity to flow along a second current path, through the resonance circuit, and through a second energy storage device.

In accordance with yet another embodiment, a computed tomography (CT) system includes a gantry having an opening therein for receiving an object to be scanned and a table positioned within the opening of the rotatable gantry and moveable through the opening. The CT system also includes an x-ray tube coupled to the rotatable gantry and configured to emit a stream of electrons toward a target, the target positioned to direct a beam of x-rays toward a detector and a deflection coil mounted on the x-ray tube and positioned to deflect the stream of electrons in a first direction. A control circuit is also included in the CT system and is electrically coupled to the deflection coil. The control circuit includes a first low voltage source, a second low voltage source and a first switch coupled to the first low voltage source and configured to create a first current path with the first low voltage source when the first switch is closed. The control circuit also includes a second switch coupled to the second low voltage source and configured to create a second current path with the second low voltage source when the second switch is closed and a resonance capacitor coupled in parallel with the deflection coil and positioned along the first and second current paths. A controller electrically is coupled to the control circuit and programmed to control switching of the first and second switches.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A control circuit for an electron beam manipulation coil for an x-ray generation system comprising:

a first low voltage source;

a second low voltage source;

a first switching device coupled in series with the first low voltage source and configured to create a first current path with the first low voltage source when in a closed position;

a second switching device coupled in series with the second low voltage source and configured to create a second current path with the second low voltage source when in a closed position; and a capacitor coupled in parallel with an electron beam manipulation coil and positioned along the first and second current paths.

2. The control circuit of claim 1 further comprising a voltage supply coupled to the first and second low voltage sources and configured to supply a voltage to the first and second low voltage sources; and wherein the first low voltage source comprises a first capacitor and the second low voltage source comprises a second capacitor.

3. The control circuit of claim 2 further comprising a blocking diode coupled in series with the voltage supply.

4. The control circuit of claim 1 further comprising a first low voltage supply coupled to the second low voltage source and configured to supply a voltage to the second low voltage source;

wherein the second low voltage source comprises a capacitor; and wherein the first low voltage source comprises a second low voltage supply.

5. The control circuit of claim 1 wherein the first and second low voltage sources are constructed to supply a voltage of approximately R*I volts, where R represents an overall parasitic resistance of the control circuit, and I represents a desired steady state current supplied to the electron beam manipulation coil.

6. The control circuit of claim 1 further comprising:

a first diode connected in series with the first switching device; and a second diode connected in series with the second switching device.

7. The control circuit of claim 1 wherein the first low voltage source, the capacitor, and the first switching device are arranged to generate a current flow having a first polarity across the electron beam manipulation coil; and wherein the second low voltage source, the capacitor, and the second switching device are arranged to generate a current flow having a second polarity, opposite the first polarity, across the electron beam manipulation coil.

8. A method for driving an electron beam manipulation coil comprising the steps of:

(A) closing a first switching device to cause a first current at a first polarity to flow along a first current path, through a resonance circuit, and through a first energy storage device, the resonance circuit comprising an electron beam manipulation coil and a resonance capacitor;

(B) opening the first switching device after closing the first switching device to initiate a first resonance cycle in the resonance circuit; and (C) closing a second switching device after the first resonance cycle has been initiated to cause a second current at a second polarity to flow along a second current path, through the resonance circuit, and through a second energy storage device.

9. The method of claim 8 comprising closing the second switching device in between the load voltage changing sign after opening the first switching device, and the end of the half resonant cycle.

10. The method of claim 8 further comprising the steps of:

(D) opening the second switching device after closing the second switching device to initiate a second resonance cycle in the resonance circuit;

(E) closing the first switching device after the second resonance cycle has been initiated to cause the first current at the first polarity to flow along the first current path, through the resonance circuit, and through the first energy storage device; and (F) repeating steps (B)-(E).

11. The method of claim 10 comprising closing the first switching device approximately 10 milliseconds after opening the second switching device.

12. The method of claim 8 wherein the step of opening the first switching device comprises initiating a discharge of energy stored in the resonance capacitor in a first direction; and wherein the step of opening the second switching device comprises initiating the discharge of the resonance capacitor in a second direction, opposite the first direction.

13. The method of claim 8 wherein the step of closing the first switching device comprises closing the first switching device based on a first desired voltage condition; and wherein the step of closing the second switching device comprises closing the second switching device based on a second desired voltage condition.

14. A computed tomography (CT) system comprising:

a rotatable gantry having an opening therein for receiving an object to be scanned;

a table positioned within the opening of the rotatable gantry and moveable through the opening;

a detector;

an x-ray tube coupled to the rotatable gantry and configured to emit a stream of electrons toward a target, the target positioned to direct a beam of x-rays toward the detector;

a deflection coil mounted on the x-ray tube and positioned to deflect the stream of electrons in a first direction;

a control circuit electrically coupled to the deflection coil, the control circuit comprising:

a first low voltage source;

a second low voltage source;

a first switch coupled to the first low voltage source and configured to create a first current path with the first low voltage source when the first switch is closed;

a second switch coupled to the second low voltage source and configured to create a second current path with the second low voltage source when the second switch is closed; and a resonance capacitor coupled in parallel with the deflection coil and positioned along the first and second current paths; and a controller electrically coupled to the control circuit and programmed to control switching of the first and second switches.

15. The CT system of claim 14 further comprising:

a second deflection coil mounted on the x-ray tube and positioned to deflect the stream of electrons in a second direction; and a second control circuit electrically coupled to the second deflection coil, the control circuit comprising:

a first low voltage source;

a second low voltage source;

a first switch coupled to the first low voltage source and configured to create a first current path with the first low voltage source when the first switch is closed;

a second switch coupled to the second low voltage source and configured to create a second current path with the second low voltage source when the second switch is closed; and a resonance capacitor coupled in parallel with the second deflection coil and positioned along the first and second current paths.

16. The CT system of claim 15 further comprising:

a first focusing coil mounted on the x-ray tube to apply a first field of focus to the stream of electrons;

a second focusing coil mounted on the x-ray tube to apply a second field of focus to the stream of electrons;

a first focusing control circuit electrically coupled to the first focusing coil, the first focusing control circuit comprising:

a first low voltage source;

a second low voltage source;

a first switch coupled to the first low voltage source and configured to create a first current path with the first low voltage source when the first switch closed;

a second switch coupled to the second low voltage source and configured to create a second current path with the second low voltage source when the second switch is closed; and a resonance capacitor coupled in parallel with the first focusing coil and positioned along the first and second current paths; and a second focusing control circuit electrically coupled to the second focusing coil, the second focusing control circuit comprising:

a first low voltage source;

a second low voltage source;

a first switch coupled to the first low voltage source and configured to create a first current path with the first low voltage source when the first switch closed;

a second switch coupled to the second low voltage source and configured to create a second current path with the second low voltage source when the second switch is closed; and a resonance capacitor coupled in parallel with the second focusing coil and positioned along the first and second current paths.

17. The CT system of claim 14 wherein the control circuit further comprises a voltage supply coupled to the first and second low voltage sources and configured to supply a voltage to the first and second low voltage sources; and wherein the first low voltage source comprises a first capacitor and the second low voltage source comprises a second capacitor.

18. The CT system of claim 14 wherein the control circuit further comprises a first low voltage supply coupled to the second low voltage source and configured to supply a voltage to the second low voltage source;

wherein the second low voltage source comprises a capacitor; and wherein the first low voltage source comprises a second low voltage supply.

19. The CT system of claim 14 wherein the controller is further programmed to:

receive a switching command corresponding to a user input; and selectively open and close the first and second switches of the control circuit based on the switching command to generate an alternating current through the deflection coil.

20. The CT system of claim 19 wherein the controller is programmed to:

open the first switch at a first time to initiate a first resonance cycle;

close the second switch at an end of the first resonance cycle;

open the second switch at a second time, following the first time, to initiate a second resonance cycle; and close the first switch at an end of the second resonance cycle.

21. The CT system of claim 19 wherein the target has a first focal spot and a second focal spot positioned thereon; and wherein the deflection coil is positioned with respect to the x-ray tube such that the alternating current causes the stream of electrons to be deflected between the first focal spot and the second focal spot based on the switching of the first and second switches.

22. The CT system of claim 21 wherein the deflection coil is positioned such that the stream of electrons is directed to the first focal spot when the first switch is closed and is directed to the second focal spot when the second switch is closed.

* * * * *